United States Patent [19]

Sasada et al.

[11] Patent Number: 4,662,820

[45] Date of Patent: May 5, 1987

[54] TURBINE STAGE STRUCTURE

[75] Inventors: Tetsuo Sasada; Takeshi Sato; Haruo Urushidani; Katsukuni Hisano; Ryoichi Kaneko; Kazuo Ikeuchi; Kunio Tsuji, all of Hitachi, Japan

[73] Assignee: Hitachi, Ltd., Tokyo, Japan

[21] Appl. No.: 752,860

[22] Filed: Jul. 8, 1985

[30] Foreign Application Priority Data

Jul. 10, 1984 [JP] Japan ..... 59-143850

[51] Int. Cl.[4] ..... F01D 11/02

[52] U.S. Cl. ..... 415/170 R

[58] Field of Search ..... 415/170 R, 172 R, 172 A, 415/121 A, 168, 171, 174; 277/53

[56] References Cited

U.S. PATENT DOCUMENTS

| | | | |
|---|---|---|---|
| 12,390 | 9/1905 | Curtis | 415/174 |
| 953,674 | 3/1910 | Westinghouse | 415/174 |
| 2,314,289 | 3/1943 | Salisbury | 415/168 |
| 2,336,323 | 12/1943 | Warren | 415/172 A |
| 2,378,372 | 6/1945 | Whittle | 415/172 A |
| 2,910,269 | 10/1959 | Haworth et al. | 415/172 A |
| 3,030,071 | 4/1962 | Scheper, Jr. | 416/193 A |
| 3,314,651 | 4/1967 | Beale | 415/172 A |
| 3,501,246 | 3/1970 | Hickey | 415/171 |
| 3,897,169 | 7/1975 | Fowler | 415/172 A |
| 4,017,088 | 4/1977 | Lerjen | 415/170 R |
| 4,161,318 | 7/1979 | Stuart et al. | 415/172 A |
| 4,370,094 | 1/1983 | Ambrosch et al. | 415/172 A |
| 4,433,845 | 2/1984 | Shiembob | 277/53 |

FOREIGN PATENT DOCUMENTS

| | | | |
|---|---|---|---|
| 477373 | 6/1929 | Fed. Rep. of Germany | 415/172 A |
| 1426857 | 12/1968 | Fed. Rep. of Germany | 415/172 A |
| 122002 | 10/1978 | Japan | 415/170 R |
| 44707 | 3/1982 | Japan | 415/174 |
| 153904 | 9/1982 | Japan | 415/174 |
| 235171 | 1/1926 | United Kingdom | 415/174 |
| 767656 | 2/1957 | United Kingdom | 415/172 A |
| 2110767 | 6/1983 | United Kingdom | 415/168 |

*Primary Examiner*—Robert E. Garrett
*Assistant Examiner*—John Kwon
*Attorney, Agent, or Firm*—Antonelli, Terry & Wands

[57] ABSTRACT

A stage structure of an axial turbine includes a stationary inner ring, a stationary outer wall, a row of stationary blades mounted on the stationary inner ring and outer wall, a row of moving blades, and a shroud ring mounted on the tips of the moving blades. An annular solid substance, disposed immediately downstream of an axial gap formed between an axial end of the shroud ring and surface of the outer wall axially facing the axial end of the shroud ring, reduces an expansion space provided immediately downstream of the axial gap, whereby circulation of an ejection flow from a main stream through the axial gap is reduced so that the turbine stage efficiency is improved. The annular solid substance may be a ring fixed to the stationary outer wall, a protrusion or a cylinder formed by a portion of the outer wall.

14 Claims, 13 Drawing Figures

TURBINE STAGE STRUCTURE

BACKGROUND OF THE INVENTION

This invention relates to an axial flow turbine such as, for example a steam turbine and, a gas turbine, more particularly, to a turbine stage structure constructed of a stationary blade row and a moving blade row.

A conventional turbine stage structure includes a row of stationary blades arranged annularly between a stationary outer wall and a stationary inner wall and a row of moving blades radially provided on a rotor disc. The moving blades have shroud ring fixed to the tips thereof. A labyrinth sealing is formed of a plurality of fins arranged in an annular space defined by the inner surface of the stationary outer wall and the shroud ring in order to minimize leakage of working fluid through the space.

In a large-sized turbine provided with several above-mentioned stages to get large output, a difference in thermal expansion occurs between the stationary wall and the rotor during a transitional period of the turbine operation such as starting and stopping. In order to prevent the stationary outer wall and the rotor from being damaged through contact, it is necessary, in a normal operation to maintain a large axial gap between an axial end of the shroud ring and an axial end portion of the stationary outer wall facing the shroud ring axial end. The difference in thermal expansion between the stationary outer wall and the rotor increases in proportion to a rise in steam temperature and pressure and an increase in machine size, so that turbines of large capacity have a large axial gap as compared with small capacity turbines.

Influence of the axial gap on stage effeciency is disclosed, for example, in Thermal Engineering Vo. 20 (1) of 1973 "The Influence of Blade Clearance on the Characteristics of a Turbine stage" by I. G. Gogolev, et al. and Thermal Engineering Vol. 20 (3) of 1973 "Comparative Tests of Pressure Stage by Two Simulaton Methods" by A. S. zil' Berman, et al. According to these publications, the turbine stage efficiency decreases as the axial gap increases. Generally, the influence of the axial gap on the efficiency can be expressed as function of ratio of the axial gap to blade length, namely, the turbine stage efficiency decreases as the blade length reduces or as the axial gap increases.

The cause of and the mechanism for reduction of efficiency due to the axial gap between the axial end of the shroud ring and the axial end of the stationary wall facing the shroud ring end has not been full understood, and it has been through that, in a high pressure turbine, the decrease in turbine efficiency occurs inherently, and consequently, no effective improvement of turbine efficiency has been proposed.

On the other hand, since the reduction of steam leakage from the tip of the moving blade, that is, the reduction of the steam leakage from the spacing between the shroud ring and the seal fins is effective for raising the turbine efficiency, there have been various measures such as increasing the number of the fins used, minimization of the radial clearance and use of the shroud ring of complicated, stepwise shape such as is disclosed in, for example, Japanese Patent Publication No. 45726/1980. According to "Non-contact sealing theory" by Kazuo Komodori, Corona Publishing Co., in the above-mentioned sealing portion, it is necessary for expansion chambers defined by the fins to have a volume to prevent leakage by causing effectively eddy loss in the expansion chamber. Therefore, it is necessary to make fins longer in length and practical steam turbines for power plants use the fins of about 10 mm length.

These steam turbines each have, at the upstream outer side of the shroud ring, an expansion space defined by an axial end face of the stationary wall facing the shroud ring, a stationary surface facing the outer surface of the shroud ring and provided with the sealing fins, and the fin at the most upstream side. Small-sized steam or gas turbines and low pressure stages of large-sized turbines can not mount the shroud rings without causing strength problems, and, consequently, such construction can not attain an effect of sealing fins. In such a case, the stationary wall is very close to the tops of the moving blades and the expansion space is small.

In general, however, high or medium pressure stages have a shroud ring to prevent decrease in efficiency, and sealing fins, with thin tips are employed so as to prevent serious damage when the shroud ring contacts the stationary wall. In such a construction, the expansion space becomes relatively large as the axial gap increases. In some cases, an increase of leakage from the blade tips due to the enlargement in the axial gap results in a decrease in stage efficiency. In such cases, the gap serves as a part of the sealing. When the axial gap is nearly equal to the radial gap in the vicinity of the sealing portion, the steam leakage at the tip of the moving blade increases as the the axial gap increases. The leakage, however, does not almost change according to the value of the axial gap when the axial gap is larger than twice the amount of the radial gap. According to the experimental results, it was determined that, even if steam leakage at the tip of the moving blade is very small with the radial gap being made very small, the turbine efficiency decreases greatly as the axial gap increases, and a large loss corresponding to several times as large as loss due to the steam leakage.

Therefore, the only prevention of the steam leakage at the tip of the moving blade is not a decisive measure for preventing the decrease in turbine stage efficiency due to an increase in the axial gap.

It was also experimentally determined that a principal cause of the decrease in turbine stage effeciency caused by an increase of the axial gap at the blade tip is an action of fluid in the axial gap or expansion space, however, presently there are no known publications in which the above-mentioned cause is disclosed.

In Japanese Patent Laid-Open No. 128008/1975, thin members are disposed generally axially in the axial gap at the blade tip with the fin members forming a plurality of passages for fluid therebetween, so as to guide the fluid so as to flow along the passages, whereby the rotor is prevented from flow-induced vibration.

This construction does not prevent the decrease in the turbine stage efficiency caused by the enlargement of the axial gap.

An object of the invention is to provide an axial flow turbine in which a decrease in turbine stage caused by enlargement of an axial gap between an axial end of a shroud ring and a stationary wall, facing the axial end of the shroud ring is prevented.

Experiments have indicated that a decrease in turbine stage efficiency, caused by enlargement of an axial gap between an axial end of a shroud ring and a stationary wall facing the axial end, occurs because of working fluid circulation which is such that a partial flow, branched from a main stream having passed through a stationary blade row, enters an expansion space formed immediately downstream of the axial gap with respect to a fluid passage formed between said stationary wall and the shroud ring to cause an eddy loss and a windage loss thereby consuming the kinetic energy. Most of the partial flow flows into and mixes with the main stream to thereby reduce kinetic energy of the main stream, and there is an increase in disturbance of the main stream caused by the circulation.

In accordance with the present invention, means are provided in the expansion chamber, for preventing the above-mentioned fluid circulation.

According to the present invention, the means for preventing the fluid circulation includes an annular solid substance provided in the expansion space immediately downstream of the axial gap between the axial end of the shroud ring and the stationary wall facing the axial end.

BRIEF DESCRIPTION OF TTHE DRAWINGS

DETAILED DESCRIPTION

Before description of embodiments of the present

Figure 1:
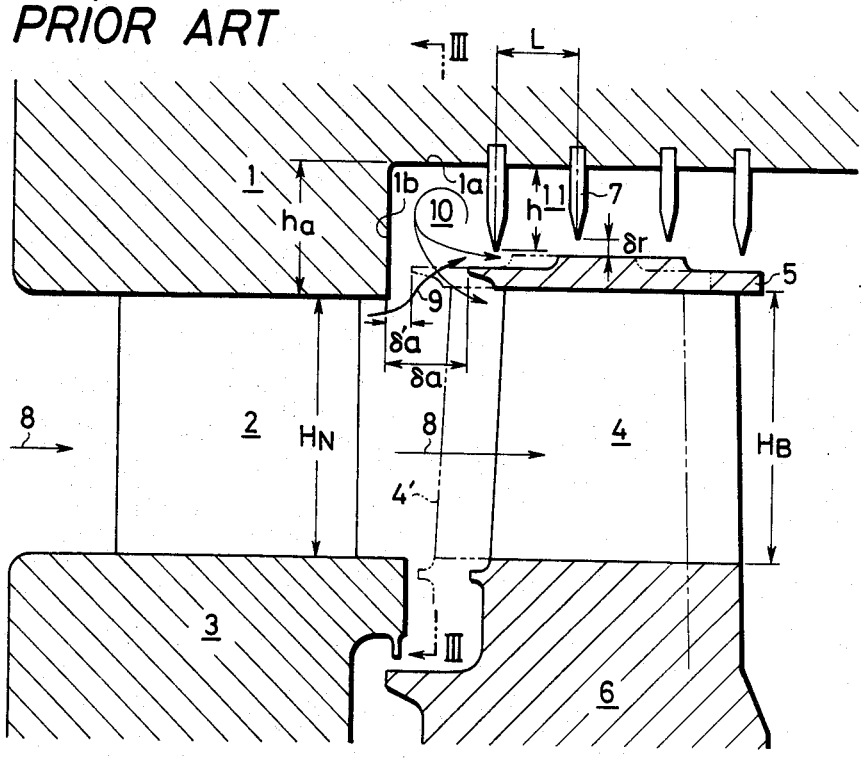
FIG. 1 PRIOR ART
FIG. 1 is a front sectional view of a prior art turbine stage structure.

Referring now to the drawings wherein like reference numerals are used throughout the various views to designate like parts and, more particularly, to FIG. 1, according to this figure, a prior art turbine stage structure includes a row of stationary blades 2 provided between a stationary outer wall 1 and a stationary inner ring 3, a row of moving blades 4 provided on a rotor disc 6, a shroud ring 5 fixed to the tip of the blades 4, and a labyrinth sealing means comprising a plurality of fins 7 disposed in a space 11 defined by the inner surface 1*a* of the stationary outer wall 1 and the outer surface of the shroud ring 5. An axial gap $\delta a$ is provided between an axial end of the shroud ring 5 and the face 1*b* of the stationary outer wall 1 in order to prevent damage due to their contact. The gap $\delta a$ is one at normal operation, the gap turns into a small gap $\delta a'$ in a transitional operation period because the moving blade is shifted to a position 4' as shown by a dotted line in such a period by difference in thermal expansion between the the rotor disc 6 and the stationary outer wall 1. Therefore, it is necessary for the gap $\delta a$ to be relatively large. The gap $\delta a$ communicates with the space 11 and an expansion space 10 is the upper reaches of the space 11 and formed by the inner surface 1*a* and the axial end face 1*b* of the stationary outer wall 1 and the fin 7 on the most upstream side.

Figure 2:
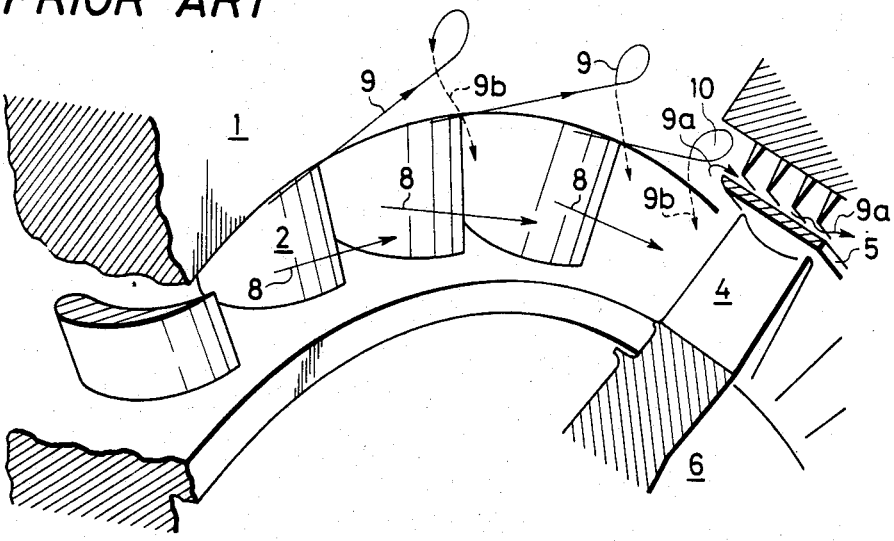
FIG. 2 PRIOR ART
FIG. 2 is a perspective view of the prior art turbine stage structure of in FIG. 1.

As shown in FIG. 2, most of a main flow 8 of steam, as a working fluid, is accelerated by the stationary blades 2, then flows into the moving blades 4 to drive the same. A part of the main flow 8, particularly a part on the outer peripheral side or an ejection flow 9 flows into the expansion space 10 by the centrifugal force due to its tangential velocity component and the suction of the expansion space 10. The ejection flow 9 loses the kinetic energy through an eddy loss and windage loss and then a part of the ejection flow 9 is exhausted as a leakage steam flow 9*a* into the downstream side of the moving blade 4 through the labyrinth sealing means. Most of the ejection flow 9 becomes a low-energy steam flow 9*b* and again flows into the main flow 8 to mix therewith whereby the main flow 8 is disturbed, so that the turbine stage efficiency decreases.

Figure 3:
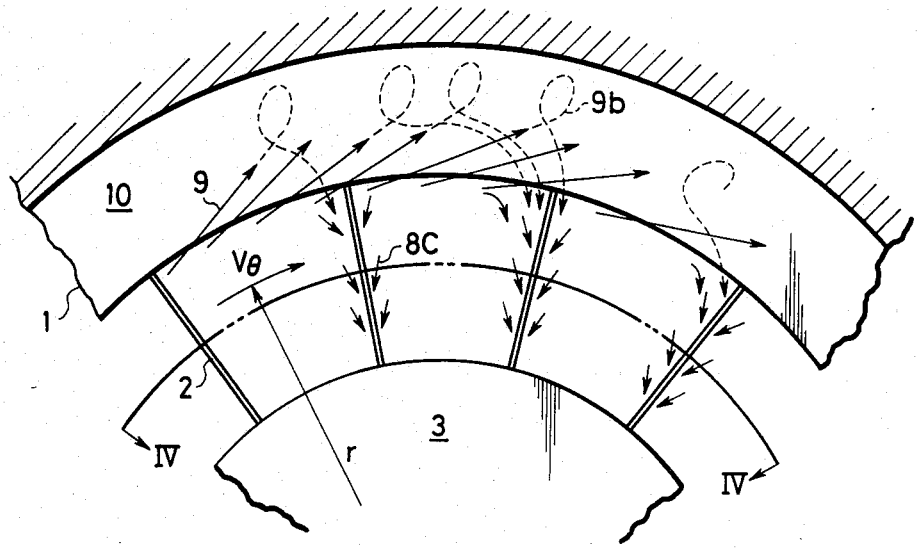
FIG. 3 PRIOR ART
FIG. 3 is a sectional view of the prior art turbine stage structure taken along a line III—III of FIG. 1.

As shown in FIG. 3, pressure distribution in the space between the stationary blades 2 and the moving blades 4 is such that the pressure is higher on the outside, which is determined from the following relationship:

$$dp/dr \propto V\theta^2/r,$$

wherein:

r: radius, and $V\theta$: circumferential velocity component of the main flow 8 at the radius r.

Figure 4:
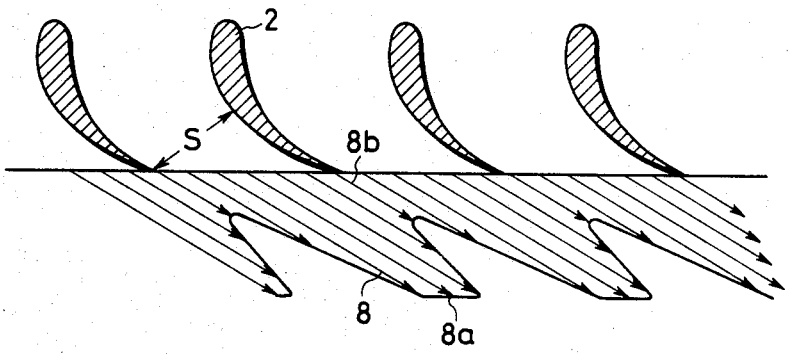
FIG. 4 PRIOR ART
FIG. 4 is a sectional view of FIG. 3 taken along line IV—IV.

On the other hand, the main flow 8 is not an uniform flow, but a non-uniform flow that includes a high speed flow 8*a* having little loss, and a low speed flow 8*b* having lost energy due to friction between the blades 2, and flowing after the high speed flow 8*a* appears periodically, as shown most clearly in FIG. 4. The wake flow 8*b* is a low speed flow so that the centrifugal force of the fluid does not balance the pressure gradient maintained by the main stream 8 and secondary flows 8*c* flow from the outer peripheral side toward the inner peripheral portion as shown in FIG. 3. The ejection flow 9, ejected into the expansion space 10, also flows toward the wake flow 8*b* after the kinetic energy has been consumed in the expansion space 10 to be a low speed flow 9*b*. Thus, by the existence of the expansion space 10, circulation flows occur such that the ejection flow 9 of a high kinetic energy goes into the expansion space 10 to lose there the kinetic energy and to be a low-energy flow 9*b*, then the low energy flow 9*b* flows into the main flow 8.

The greater the quantity of the circulation flow, that is, the larger the volume of the expansion space, the more the turbine stage efficiency decreases. And whether the amount of the leakage of the fluid passing through the sealing is much or not, the turbine stage efficiency decrease by the expansion space 10.

As above-mentioned, and according to the experimental results, the decrease in turbine stage efficiency due to the circulation flow relies on not only the axial gap but also the volume of the expansion space 10.

The turbine stage efficiency decreases according to an increase in a parameter expressed by the following equation:

$$f_a = \frac{\delta a \cdot ha}{N \cdot H_N \cdot S}$$

wherein,

δa: the axial gap, ha: the depth of the expansion space

S: throat width of the flow pass, defined between two adjacent stationary blades 2, $H_N$: blade length of the stationary blades 2, and N: number of the stationary blades.

As is apparent from the above explanation, even if it is inevitable to make the axial gap small, the turbine stage efficiency can be increased by making the expansion space small.

Figure 5:
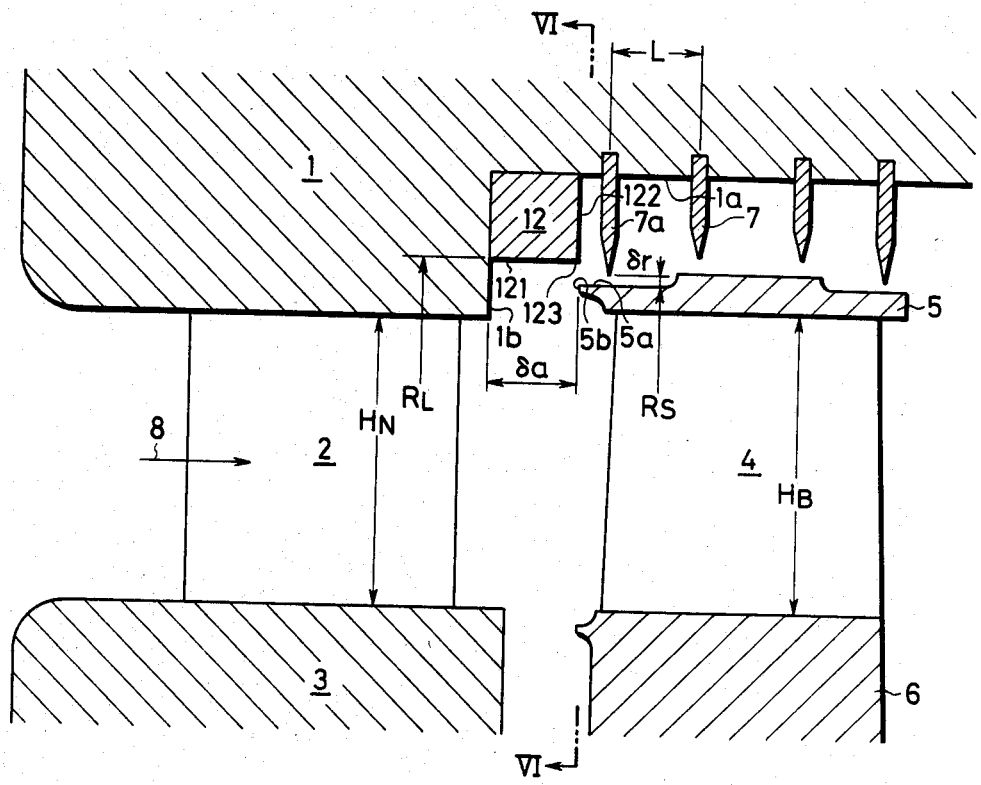
FIG. 5 is a sectional view of an embodiment of turbine stage according to the present invention.

In accordance with the present invention, the turbine stage structure, as shown in FIG. 5, includes a stationary outer wall 1 having a cylindrical bore for mounting a row of stationary blades 2 thereon and a larger-diameter cylindrical bore forming a cylindrical space. The stationary blades 2 are annularly arranged and fixed to the stationary outer wall 1 and a stationary inner ring 3. In the cylindrical space, a row of moving blades 6, provided on a rotor disc 6 is disposed so as to align with the row of stationary blades 2. A shroud ring 5 is fixed to the tip of the moving blades 6 to form an annular space between the inner surface 1*a* of the stationary outer wall 1 and the outer surface 5*a* of the shroud ring 5. An axial gap δ*a* is formed between the upstream side end 5*b* of the shroud ring 5 and an end surface 1*b* of the stationary outer wall 1 opposite the upstream side shroud ring end 5*b*. A labyrinth sealing means including a plurality of fins 7*a*,7 spaced at a distance L, is disposed in the annular space, so that a radial gap δ*r* is formed between the tip of the fins 7*a*, 7 and the outer surface 5*a* of the shroud ring 5.

An annular solid substance 12 is made of a ring and disposed in an expansion space immediately downstream of the axial gap and defined by the inner surface 1*a* and the axial end face 1*b* of the stationary outer wall 1 and the most upstream side fin 7*a*. The annular solid substance ring 12 has an inner surface 121 and a side face 122. The inner surface 121 and the side face 122 instersect at a corner 123.

The annular solid substance ring 12 is secured to the stationary outer wall 1 by for example, welding, threaded means or the like. Alternatively, the annular solid substance ring 12 may be formed of the stationary outer wall 1 by machining.

The minimum radius $R_L$ of the inner surface 121 of the annular solid substance ring 12 is larger than one Rs of the outer surface of the shroud ring 5, and the radius $R_L$ is determined as in accordance with the following equation:

$$R_L = Rs + (1.2 \sim 1.5) x \delta r$$

Even if the moving blade 4 is shifted in an axial direction due to difference in thermal expansion between the stationary outer wall 1 and the rotor 6, the annular solid substance ring 12 does not contact the shroud ring 5 so that damage due to rubbing never occurs. The width W, that is the axial length of the annular solid substance ring 12 is nearly equal to the axial gap δ*a*, however, if the width is more than ½ δ*a*, the annular solid substance ring 12 has an effect of reducing a turbine stage efficiency decrease. Further, even if the width W of the annular solid substance ring 12 is larger than the annular gap δ*a*, the above-mentioned effect is brought forth, however, it is more effective for reducing the turbine stage efficiency decrease, to provide a space large enough to raise sealing effect to minimize the leakage at the labyrinth sealing means formed by the fins 7, 7*a* because both the effect that the leakage of steam through the sealing means is reduced to thereby reduce an amount of an ejection flow passing through the axial gap δ*a* and the effect that the circulation of steam from a main stream 8 is reduced in the minimized expansion space are brought forth at the same time. Therefore, the width W is preferably determined in accordance with the following relationship:

$$W = \tfrac{1}{2}\delta a \sim \delta a.$$

Figure 6:
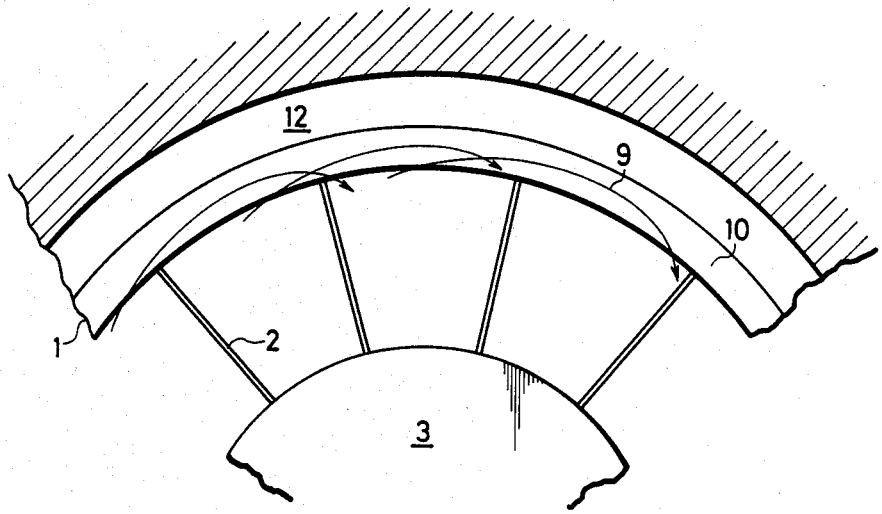
FIG. 6 is a sectional view of FIG. 5 taken along a line VI—VI.

As is apparent from FIG. 6, the provision of the annular solid substance ring 12 reduces the volume of the expansion space and restricts an amount of the ejection flow 9 entering the expansion space through the axial gap δ*a* to be small, and it is possible to reduce the eddy loss and the windage loss.

Figure 7:
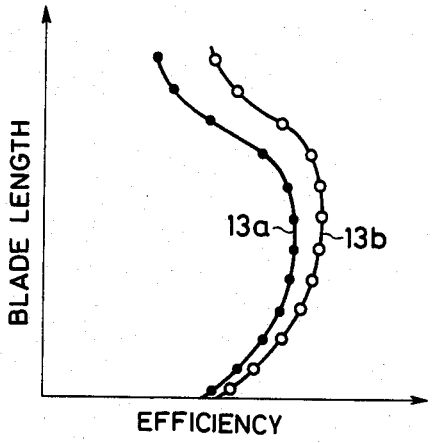
FIG. 7 is a graphical illustration of relationships between blade length and turbine stage efficiency.

FIG. 7 shows comparison of measurement results, with the curve 13*a* representing a distribution of stage efficiency in the blade length direction by the prior art turbine stage structure, and the other curve 13*b* representing the present invention. From FIG. 7, it is noted that the turbine stage efficiency is improved almost over an entire range of the turbine stage by the provision of the annular solid substance ring 12. This also means that by the foregoing circulation of the low energy flow 9*b*, the low kinetic energy flow 9 disperses over the blade length and lowers the kinetic energy of the main stream 8 to thereby reduce the stage efficiency. Therefore, the turbine stage structure which reduces the foregoing circulation of the flow 9*b* according to the present invention greatly improves the stage efficiency. For example, when the parameter $f_a$ is reduced from 0.04 to about 0.004, 3% of the turbine stage efficiency is improved.

Figure 8:
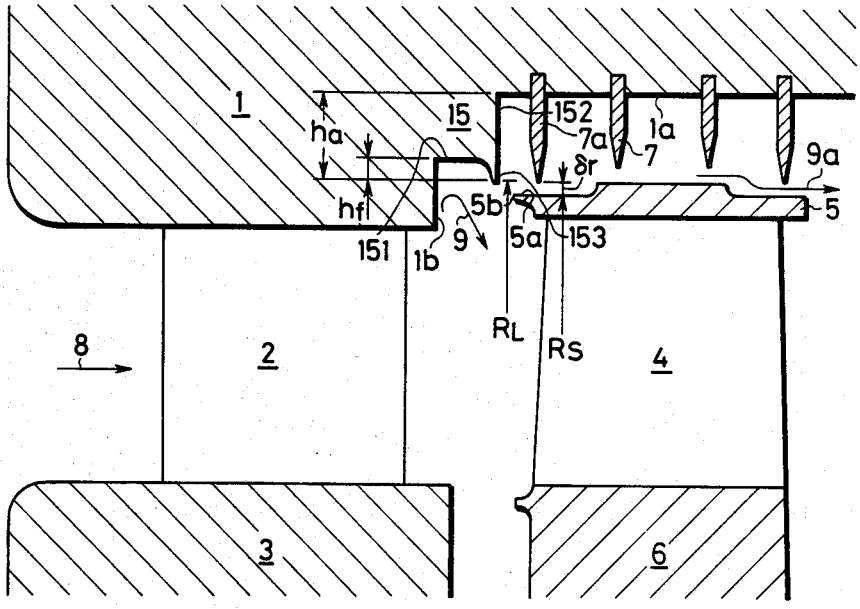
FIGS. 8 and 9 are sectional views of two further embodiments of the turbine stage structure according to the present invention.

In FIG. 8, and annular solid substance or protrusion 15 is a part of the stationary outer wall 1 and protrudes radially inward. The annular solid substance or protrusion 15 includes an inner surface 151 and side surface 152, with the inner surface 151 being provided with an annular projection 153 at an intersection of the inner surface 151 and the side face 152. The inner radius $R_L$ of the projection 153 is larger than the radius Rs of the shroud ring outer periphery, and it is nearly equal to the corresponding value of the embodiment shown in FIG. 5.

The depth hf of the projection 153 is determined in accordance with the following relationship:

$$hf = \delta r \sim 2\delta r$$

wherein:

$\delta_r$ is a radial gap between the seal fin 7*a* and the outer periphery 5*a* of the shroud ring 5.

Further, the depth hf is set as follows to the depth ha of the protrusion 15 so as not to reduce the effect of blocking the expansion space which corresponds to space 10 in FIG. 1 defined by an axial extension of the inner surface 1*a* and a radial extension of the axial end 1*b* of the stationary outer wall 1:

$$hf = 0.1ha \sim 0.4ha.$$

The construction of FIG. 5 is sufficient to prevent the decrease in the stage efficiency caused by the circulation of the steam flow but the inner surface of the protrusion 15 is flat and in parallel to the main stream 8 so that it does not have an effect that a leakage steam flow 9*a* passing through the seal fin gap $\delta r$, is prevented and the protrusion introduces the leakage steam flow 9*a* into the seal gap $\delta r$ of the fins and thereby increasing a blow through effect, whereby an amount of leakage steam flow 9*a* at the moving blade tip may be sometimes increased.

The annular member 15 of FIG. 8 directs the ejection steam flow 9 toward the inside by the projection 153, whereby the leakage flow 9*a*, passing through the most upstream side seal fin 7*a*, is reduced so that an amount of the leakage steam decreases.

Figure 9:
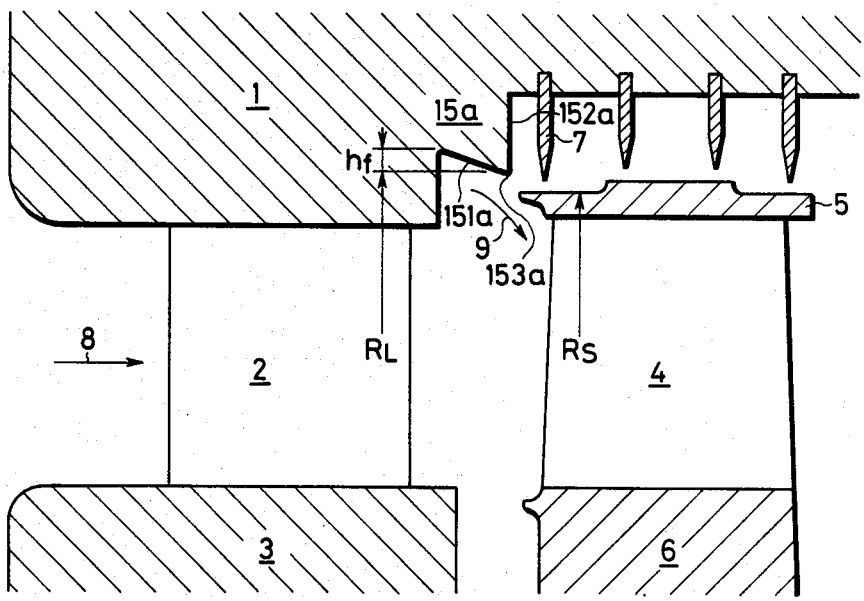

In the embodiment of FIG. 9, the annular solid substance is an annular protrusion 15*a* made of a part of the stationary outer wall 1 and having an inner surface 151*a* and a side 152*a*, with the inner surface 151*a* inclined so that the radius decreases toward an annular corner 153*a*. The minimum radius $R_L$ of the inner surface 151*a* is at the corner 153 and larger than Rs of the outer surface of the shroud ring 5. The difference hf in radius of the inner surface 151*a* of the annular protrusion 15*a* corresponds to the depth of the annular projection 153 in FIG. 8. The difference hf, the depth and width of the annular protrusion 15*a* are the same as the depth and width of the annular protrusion 15 in FIG. 8.

With a construction of the turbine stage as shown in FIG. 9, the circulation prevention effect as explained in the connection with FIG. 5 and the restriction effect that the leakage flow 9*a* is restricted by directing the ejection flow 9 to the inside of the main flow 8 as explained in connection with the embodiment of FIG. 8 are brought forth, thereby increasing the stage efficiency.

Figure 10:
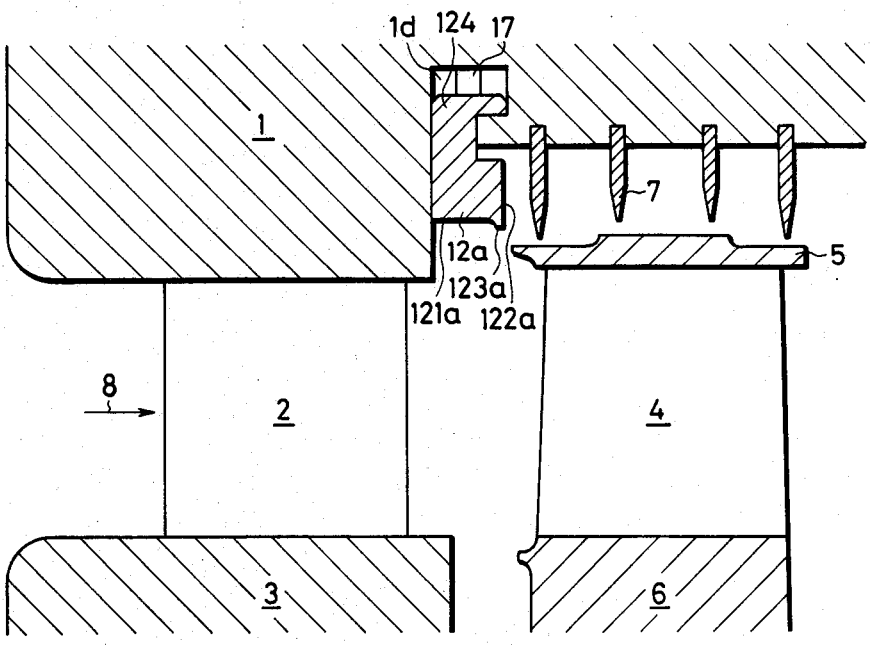
FIGS. 10 and 11 are sectional views of further embodiments of the turbine stage of FIG. 8.

In the embodiment of FIG. 10, annular solid substance is an annular member 12*a* divided into several parts with respect to the peripheral direction, with each of the several parts being inserted in a recess 1*d* of the stationary outer wall 1 while being shifted in the peripheral direction, and pressed by a sheet spring 17. The annular member 12*a* also has an inner surface 121*a*, a side 122*a* and a projection corner 123*a* so that the function is substantially the same as the embodiment of FIG. 8. According to the embodiment of FIG. 10, damage due to contact between the annular member 12*a* and the shroud ring 5 cannot occur even if an abnormal violent vibration takes place.

Figure 11:
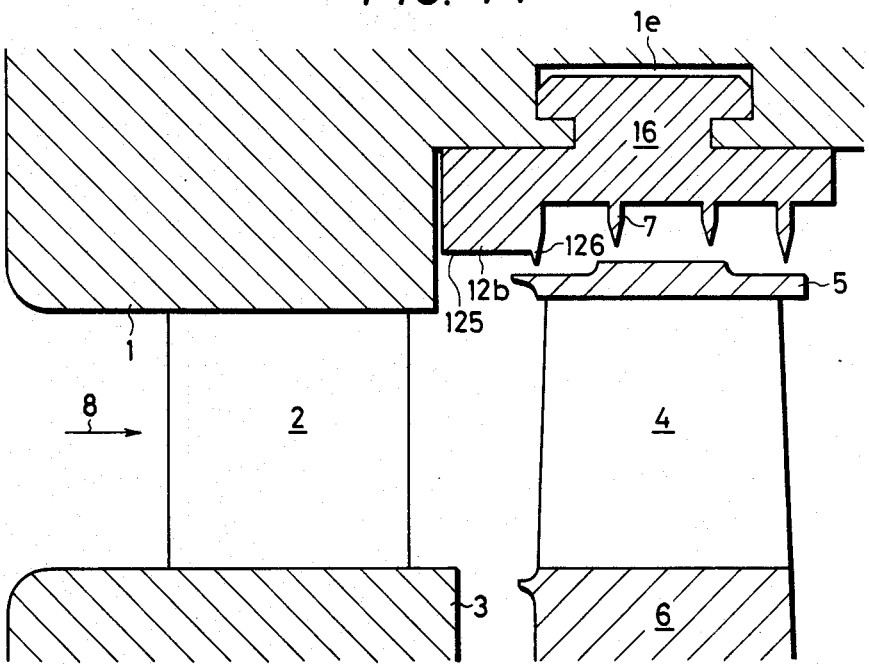

In the embodiment of FIG. 11, a packing 16 provided with a seal fins 7 and an annular block 12*b* is mounted in a recess formed in the stationary outer wall 1. The annular block 12*b* has an inner surface 125 and a corner projection 126. The corner projection faces the outer surface of the shroud ring 5 with a gap.

Figure 12:
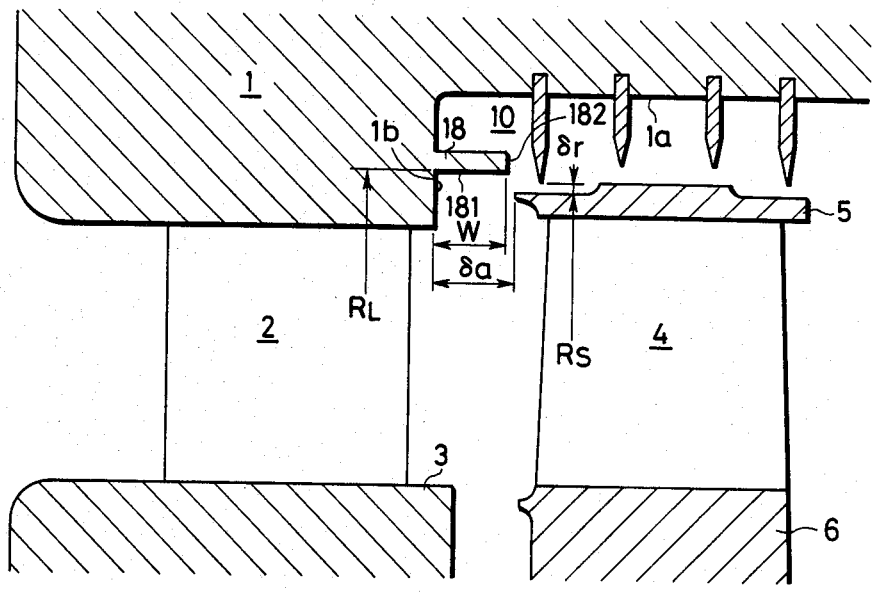
FIG. 12 is a sectional view of a further embodiment of a turbine stage structure according to the present invention.

In the embodiment of FIG. 12, the annular solid substance is made of a part of the stationary outer wall 1, which part is a cylinder 8 projecting from the axial end suface 1*b* into an expansion space 10. The cylinder 18 has an inner surface 181 the radius $R_L$ of which is larger than the radius Rs of the outer surface of the shroud ring 5. The width W of the cylinder 18 is nearly equal to or a little larger than the axial gap $\delta a$ between the upstream side end of the shroud ring 5 and the axial end surface of the stationary outer wall 1.

The cylinder 18 prevents an ejection flow 9 from flowing into the expansion space 10, whereby the circulation of the ejection flow 9 is suppressed, and the stage efficiency is increased. Since there is the expansion space in the outside of the cylinder 18, it is preferable for the width W to be as large as possible as long as the cylinder 18 does not contact a seal fin 7, and to prevent the ejection flow 9 from flowing into the expansion space.

Figure 13:
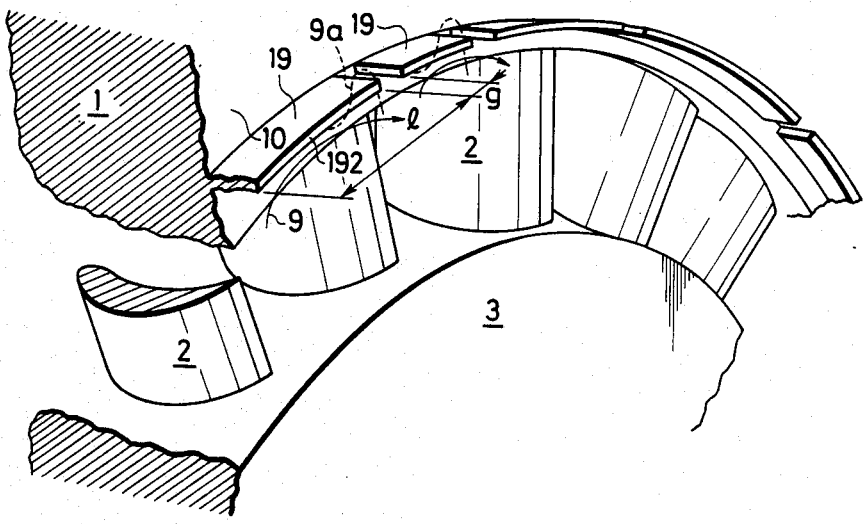
FIG. 13 is a perspective view of another embodiment of the turbine stage structure according to the present invention.

In the embodiment of FIG. 13, the annular solid substance is a cylinder 19, similar to the cylinder 18 in FIG. 12, except that the cylinder 19 is divided into several pieces in the peripheral direction by a circumferential gap g determined in accordance with the following relationship:

$$g=0.1l,$$

wherein: l=a length of a piece of cylinder 19.

According to the embodiment of FIG. 13, the cylinder 19 prevents the ejection flow 9 from entering an expansion space 10 so that most of the ejection flow 9 is prevented from entering. Therefore, in the same way as the cylinder 8 in FIG. 12, the circulation of the ejection flow 9 is suppressed and stage efficiency can be improved.

Further, since there are the circumferential gaps g between the cylinder pieces, a part 9*a* of ejection flow 9 goes around the axial end 192 into the expansion space 10 and even if an amount of the ejection flow 9*a* is very small the ejection flow 9*a* turns a steam flow directed to the labyrinth sealing means to the expansion space 10 just before the most upstream side fin so that leakage at the moving blade tip which flow through the labyrinth sealing is reduced. Thus, the embodiment of FIG. 13 is effective in decreasing leakage loss as well as attaining the above-described circulation prevention effect.

According to the present invention, internal efficiency in the high pressure section of a steam turbine with a large axial gap $\delta a$ for practical power plants can be improved by about 1~3%.

What is claimed is:

1. A stage structure of an axial trubine comprising:

a row of stationary blades arranged annularly;

a stationary member, mounting thereon said stationary blade row so as to pass a working fluid through said stationary blade row and having a cylindrical space on the downstream side of said stationary blade row;

a row of moving blades provided on a roter disc and disposed in said cylindrical space so as to face said stationary blade row with a distance therebetween;

a shroud ring mounted on said moving blades at the tip thereof and providing both an axial gap between an axial end of said shroud ring on the upstream side and an axial end face of said stationary member opposite to said axial end of said shroud ring, and an annular space defined by the inner surface of said stationary member forming said cylindrical space and the outer surface of said shroud ring;

a labyrinth sealing mounted on said stationary member and disposed in said annular space; and an annular solid substance ring having an inner peripheral smooth surface the minimum radius of which is larger than the radius of the outer surface of said shroud ring, and extending from said axial end surface of said stationary member toward said labyrinth sealing so as to reduce an expasion space defined downstream of said axial gap by said inner surface and said axial end surface of said stationary member and the most upperstream end of said labyrinth sealing, whereby an amount of working fluid circulating through said axial gap and said expansion space is reduced greatly.

2. The stage structure as defined in claim 1, wherein said annular solid substance ring is a part of said stationary member having an inner surface extending from said axial end surface of said stationary member toward the labyrinth sealing side and facing said axial gap, and a side face extending from said inner surface of said stationary member toward the rotor disc side and facing said labyrinth sealing.

3. The stage structure as defined in claim 2, wherein said inner surface of said annular solid substance ring inclines so that the radius of said inner surface decreases toward said side surface.

4. The stage structure as defined in claim 2, wherein said annular solid substance ring has an annular projection for guiding fluid to flow into a main stream at the intersection of said inner surface and said side face.

5. The stage structure as defined in claim 1, wherein said annular solid substance ring is mounted on the stationary wall so as to form a part of said stationary wall extending substantially from said inner surface.

6. The stage structure as defined in claim 5, wherein said ring is divided into a plurality of pieces which are inserted in an annular recess formed in stationary wall and pressed inward by means of a spring.

7. The stage structure as defined in claim 5, wherein said ring is integrated in a packing mounted on the stationary wall, said labyrinth sealing havinng fins and being included in said packing.

8. The stage structure as defined in claim 1, wherein said annular solid substance ring is a cylinder projecting from an axial end surface of said stationary wall facing the axial end of said shroud ring.

9. The stage structure as defined in claim 8, wherein said cylinder has a width which is at least substantically equal to the axial gap.

10. The stage structure as defined in claim 9, wherein said cylinder is divided into a plurality of pieces and has therebetween a gap which in about 0.10 times the length of said each piece.

11. A stage structure of a steam turbine of large capacity comprising:

a row of stationary blades arranged annularly;

a stationary member, mounting thereon said stationary blade row so as to pass a working fluid through said stationary blade row and having a cylindrical space on the downstream side of said stationary blade row;

a row of moving blades provided on a rotor disc and disposed in said cylindrical space so as to face said stationary blade row with a distance therebetween;

a shroud ring mounted on said moving blades at the tip thereof and providing both an axial gap between an axial end face opposite to said axial end of said shroud ring, and an annular space defined by the inner surface of said stationary member forming said cylindrical space and the outer surface of said shroud ring;

a labyrinth sealing means disposed in said annular space and mounted on said stationary member to provide a gap $\delta r$ between said labyrinth sealing means and said shroud ring; and an annular member portion formed of said stationary member, having an inner peripheral smooth surface of a radius (RL) of within a range of $(Rs+1.2\delta r)$ to $Rs+1.5\delta r)$, wherein, Rs is the radius of the outer surface of said shroud ring near the upstream side, and extending from said axial end surface of said stationary member to around said axial end of said shroud ring on the upstream side so as to form a reduced expansion space immediately downstream of said axial gap.

12. The stage structure as defined in claim 11, wherein said labyrinth sealing means includes fins of a length of about 10 mm.

13. The stage structure as defined in claim 11, wherein said annular member portion has an annular projection for guiding fluid to flow into a main stream around the intersection of said annular inner surface and said side face, the height of said projection being $\delta r-2\delta r$.

14. The stage structure as defined in claim 11, wherein said inner surface of said annular member portion inclines so that the radius of said inner surface decreases toward said side surface.

* * * * *